US007515024B2

(12) United States Patent
Chen et al.

(10) Patent No.: US 7,515,024 B2
(45) Date of Patent: Apr. 7, 2009

(54) MOVEMENT MECHANISM FOR A GROUND FAULT CIRCUIT INTERRUPTER WITH AUTOMATIC PRESSURE BALANCE COMPENSATION

(75) Inventors: Wusheng Chen, Yueqing Zhejiang (CN); Fu Wang, Yueqing Zhejiang (CN); Huaiyin Song, Yueqing Zhejiang (CN)

(73) Assignee: General Protecht Group, Inc., Zhejiang (CN)

( * ) Notice: Subject to any disclaimer, the term of this patent is extended or adjusted under 35 U.S.C. 154(b) by 166 days.

(21) Appl. No.: 11/588,018

(22) Filed: Oct. 26, 2006

(65) Prior Publication Data

US 2007/0217100 A1 Sep. 20, 2007

(30) Foreign Application Priority Data

Mar. 6, 2006 (CN) ..... 2006 1 0058766

(51) Int. Cl.
*H01H 67/02* (2006.01)
*H01H 1/20* (2006.01)

(52) U.S. Cl. ..... 335/132; 335/126; 200/243

(58) Field of Classification Search ..... 335/126, 335/132; 200/275, 243, 16 A, 531
See application file for complete search history.

(56) References Cited

U.S. PATENT DOCUMENTS 3,155,790 A * 11/1964 Lemonnier ..... 335/124
3,202,886 A * 8/1965 Kramer ..... 335/234
3,218,424 A * 11/1965 Salerno ..... 200/246
3,460,081 A * 8/1969 Tillman ..... 335/234
3,634,735 A * 1/1972 Komatsu ..... 361/194
3,728,654 A * 4/1973 Tada ..... 335/234
4,489,296 A * 12/1984 Guery et al. ..... 335/197
4,533,890 A * 8/1985 Patel ..... 335/234
4,594,484 A * 6/1986 Lemmer ..... 200/16 A
4,620,172 A * 10/1986 Rudolf ..... 335/78
4,630,015 A * 12/1986 Gernhardt et al. ..... 335/18
4,931,894 A 6/1990 Legatti
4,979,070 A 12/1990 Bodkin
5,053,931 A 10/1991 Rushing
5,095,856 A * 3/1992 Kawamura ..... 123/90.11
5,173,673 A * 12/1992 Weigand et al. ..... 335/18
5,223,810 A 6/1993 Van Haaren
5,229,730 A 7/1993 Legatti et al.
5,293,507 A * 3/1994 Hayakawa ..... 200/244
5,334,939 A 8/1994 Yarbrough
5,363,269 A 11/1994 McDonald (Continued)

*Primary Examiner*—Elvin G Enad
*Assistant Examiner*—Alexander Talpalatskiy
(74) *Attorney, Agent, or Firm*—Morris Manning Martin LLP; Tim Tingkang Xia

(57) ABSTRACT

A magnetic movement mechanism usable in a ground fault circuit interrupter, comprising: (i) a first permanent magnet, (ii) a second permanent magnet positioned apart from the first permanent magnet, (iii) a soft magnet positioned between the two permanent magnets, (iv) a balance frame positioned between the two ends of the soft magnet, (v) a first coil and (vi) a second coil, wherein the first coil and the second coil are arranged such that when a current passes through the first coil, a first magnetic force is generated to cause the soft magnet and the balance frame to move towards the first permanent magnet in a first direction, and when a current passes through the second coil, a second magnetic force is generated to cause the soft magnet and the balance frame to move towards the second permanent magnet in a second direction that is opposite to the first direction.

20 Claims, 4 Drawing Sheets

U.S. PATENT DOCUMENTS 5,418,678 A 5/1995 McDonald
5,448,443 A 9/1995 Muelleman
5,470,043 A * 11/1995 Marts et al. ..... 251/65
5,477,412 A 12/1995 Neiger et al.
5,541,800 A 7/1996 Misencik
5,552,964 A * 9/1996 Naito ..... 361/781
5,642,248 A 6/1997 Campolo et al.
5,654,857 A 8/1997 Gershen
5,661,623 A 8/1997 McDonald et al.
5,673,360 A 9/1997 Scripps
5,680,084 A * 10/1997 Kishi et al. ..... 335/151
5,684,272 A 11/1997 Gernhardt et al.
5,706,155 A 1/1998 Neiger et al.
5,729,417 A 3/1998 Neiger et al.
5,757,598 A 5/1998 Aromin
5,786,971 A 7/1998 Chan et al.
5,825,599 A 10/1998 Rosenbaum
5,841,615 A 11/1998 Gershen
5,899,761 A 5/1999 Crane et al.
5,906,517 A 5/1999 Crane et al.
5,963,406 A 10/1999 Neiger et al.
5,963,408 A 10/1999 Neiger et al.
6,021,034 A 2/2000 Chan et al.
6,040,967 A 3/2000 DiSalvo
6,047,672 A * 4/2000 Hanai et al. ..... 123/90.11
6,052,265 A 4/2000 Zaretsky et al.
6,052,266 A 4/2000 Aromin
6,128,169 A 10/2000 Neiger et al.
6,226,161 B1 5/2001 Neiger et al.
6,246,558 B1 6/2001 DiSalvo et al.
6,252,407 B1 6/2001 Gershen
6,259,340 B1 7/2001 Fuhr et al.
6,262,871 B1 7/2001 Nemir et al.
6,282,070 B1 8/2001 Ziegler et al.
6,292,337 B1 9/2001 Legatti et al.
6,339,525 B1 1/2002 Neiger et al.
6,381,112 B1 4/2002 DiSalvo
6,381,113 B1 4/2002 Legatti
6,407,469 B1 6/2002 Cline et al.
6,407,893 B1 6/2002 Neiger et al.
6,414,577 B1 * 7/2002 Hoffman ..... 335/229
6,424,243 B1 * 7/2002 Forster ..... 335/132
6,433,555 B1 8/2002 Leopold et al.
6,437,700 B1 8/2002 Herzfeld et al.
6,437,953 B2 8/2002 DiSalvo et al.
6,437,955 B1 8/2002 Duffy et al.
6,442,007 B1 8/2002 Li
6,465,735 B2 10/2002 May
6,515,564 B2 2/2003 Leopold et al.
6,532,139 B2 3/2003 Kim et al.
6,538,862 B1 3/2003 Mason, Jr. et al.
6,540,533 B1 4/2003 Schreiber
6,577,478 B2 6/2003 Kim et al.
6,611,406 B2 8/2003 Neiger et al.
6,643,108 B2 11/2003 Cline et al.
6,646,838 B2 11/2003 Ziegler et al.
6,657,834 B2 12/2003 DiSalvo
6,671,145 B2 12/2003 Germain et al.
6,697,238 B2 2/2004 Bonilla et al.
6,724,589 B1 4/2004 Funderburk
6,734,680 B1 5/2004 Conard
6,734,769 B1 5/2004 Germain et al.
6,747,367 B2 6/2004 Cline et al.
6,771,152 B2 8/2004 Germain et al.
6,788,504 B2 9/2004 Vanderkolk
6,813,126 B2 11/2004 DiSalvo et al.
6,828,886 B2 12/2004 Germain et al.
6,836,201 B1 * 12/2004 Devenyi et al. ..... 335/229
6,837,729 B2 * 1/2005 Hogue et al. ..... 439/289
6,850,394 B2 2/2005 Kim
6,859,044 B2 2/2005 Hughes
6,864,766 B2 3/2005 DiSalvo et al.
6,867,954 B2 3/2005 Wu et al.
6,873,231 B2 3/2005 Germain et al.
6,897,381 B2 5/2005 He et al.
6,915,992 B1 7/2005 Gretz
6,944,001 B2 9/2005 Ziegler et al.
6,946,935 B2 9/2005 Wu et al.
6,949,994 B2 9/2005 Germain et al.
6,949,995 B2 9/2005 Leopold et al.
6,954,125 B2 * 10/2005 Wu et al. ..... 335/18
6,958,463 B1 10/2005 Kochman et al.
6,963,260 B2 11/2005 Germain et al.
6,972,572 B2 12/2005 Mernyk et al.
6,975,492 B2 12/2005 DiSalvo
6,982,856 B2 1/2006 Bernstein
6,991,495 B1 1/2006 Aromin
2002/0153982 A1 * 10/2002 Jones et al. ..... 335/220
2003/0090351 A1 * 5/2003 Chen et al. ..... 335/132
2003/0210117 A1 * 11/2003 Arnholt ..... 335/132
2006/0071748 A1 * 4/2006 Nelson ..... 335/220
2006/0198066 A1 * 9/2006 Chen et al. ..... 361/42

* cited by examiner

MOVEMENT MECHANISM FOR A GROUND FAULT CIRCUIT INTERRUPTER WITH AUTOMATIC PRESSURE BALANCE COMPENSATION

CROSS-REFERENCE TO RELATED APPLICATION

This application claims priority of Chinese Patent Application No. 2006 1005 8766.0, filed on Mar. 6, 2006, entitled "Movement mechanism for a ground fault circuit interrupter with automatic pressure balance compensation" by Wusheng CHEN, Fu WANG, and Huaiyin SONG, the disclosure of which is incorporated herein by reference in its entirety.

FIELD OF THE PRESENT INVENTION

The present invention generally relates to a leakage current protection device for appliances. More particularly, the present invention relates to a movement mechanism for a ground fault circuit interrupter with automatic pressure balance compensation.

BACKGROUND OF THE PRESENT INVENTION

Ground fault circuit interrupters (hereinafter "GFCI") are required and widely used in the construction of residential or office buildings. The ground fault circuit interrupters save lives and effectively prevent accidental electrical shock, electrical equipment damage, and fire due to leakage current, damage to electric wires etc. The ground fault circuit interrupters disconnect/connect input AC power with a movement mechanism. Usually, such movement mechanism moves six sets of silver contact points to make or break the AC power connection. In traditional ground fault circuit interrupter construction, contacts between sets of movable and stationary contact points may not be very reliable. Adequate and reliable contacts between the contact points are not guaranteed. Thus, a ground fault circuit interrupter that guarantees adequate and reliable contact is desirable.

Therefore, a heretofore unaddressed need exists in the art to address the aforementioned deficiencies and inadequacies.

SUMMARY OF THE PRESENT INVENTION

In one aspect, the present invention relates to a magnetic movement mechanism usable in a ground fault circuit interrupter. In one embodiment, the magnetic movement mechanism comprises: (i) a first permanent magnet, (ii) a second permanent magnet positioned apart from the first permanent magnet, (iii) a soft magnet with a first end, an opposite, second end, and a body portion defined therebetween, wherein the soft magnet is positioned between the first permanent magnet and the second permanent magnet such that the first end of the soft magnet is proximate to the first permanent magnet, and the second end of the soft magnet is proximate to the second permanent magnet, respectively, (iv) a balance frame positioned between the first end and the second end of the soft magnet, wherein the balance frame defines an opening configured to receive the body portion therein so that the balance frame and the soft magnet are movable together, (v) a first coil wound around the first end of the soft magnet, and (vi) a second coil wound around the second end of the soft magnet. The first coil and the second coil are arranged such that when a current passes through the first coil, a first magnetic force is generated to cause the soft magnet and the balance frame to move towards the first permanent magnet in a first direction, and when a current passes through the second coil, a second magnetic force is generated to cause the soft magnet and the balance frame to move towards the second permanent magnet in a second direction that is opposite to the first direction.

In one embodiment, the balance frame further comprises a first arm portion extending away radially from the body portion of the soft magnet, and an opposite, second arm portion extending away radially from the body portion of the soft magnet, respectively. Each of the first arm portion and the second arm portion comprises: (i) a body portion having a first surface, an opposite, second surface, at least one first side surface, and an opposite, second side surface, (ii) at least one first position limiting member protruding from the first side surface and away from the second surface, (iii) at least one opposite, second position limiting member protruding from the second side surface and away from the second surface, and (iv) a center position limiting member protruding away from the second surface. The first side surface and the second side surface connect the first surface and the second surface, respectively, and the second surface is configured to have a curvature and a corresponding axis.

In one embodiment, the balance frame further comprises a first movable contact mountable on the second surface of the first arm portion, and a second movable contact mountable on the second surface of the second arm portion of the balance frame, respectively. The first movable contact defines an opening corresponding to the center position limiting member of the first arm portion and is configured such that the when the first movable contact is mounted on the second surface of the first arm portion, the center position limiting member removably engages the first movable contact through the opening. The first movable contact is positioned between the at least one first position limiting member and the at least one opposite, second position limiting member of the first arm portion and at least movable corresponding to the curvature and relative to the axis of the second surface of the first arm portion. The second movable contact defines an opening corresponding to the center position limiting member of the second arm portion and is configured such that the when the second movable contact is mounted on the second surface of the second arm portion, the center position limiting member removably engages the second movable contact through the opening. The second movable contact is positioned between the at least one first position limiting member and the at least one opposite, second position limiting member of the second arm portion and at least movable corresponding to the curvature and relative to the axis of the second surface of the second arm portion, respectively.

In one embodiment, each of the first movable contact and the second movable contact is electrically conductive and has a first end, an opposite, second end, and a body portion defined therebetween. The first movable contact further comprises a first contact point positioned at the first end, and a second contact point and a third contact point positioned at the second end, wherein the second contact point and the third contact point are spaced apart from each other. The second movable contact further comprises a fourth contact point positioned at the first end, and a fifth contact point positioned at the second end.

In one embodiment, the magnetic movement mechanism further comprises a first stationary contact point, a second stationary contact point, and a third stationary contact point positioned in proximity of and contactable with the first contact point, the second contact point and the third contact point of the first movable contact, respectively. The magnetic movement mechanism further comprises a fourth stationary contact point, and a fifth contact point positioned in proximity of and contactable with the fourth contact point and the fifth contact point of the second movable contact, respectively. The first stationary contact point, the second stationary contact point, the third stationary contact point, the fourth stationary contact point and the fifth stationary contact point are configured such that when a current passes through the first coil, the first magnetic force causes the balance frame to move towards the first permanent magnet and thereby electrically disconnect the first contact point, the second contact point, the third contact point, the fourth contact point and the fifth contact point from the first stationary contact point, the second stationary contact point, the third stationary contact point, the fourth stationary contact point and the fifth stationary contact point, respectively. When a current passes through the second coil, the second magnetic force causes the balance frame to move towards the second permanent magnet and thereby electrically connect the first contact point, the second contact point, the third contact point, the fourth contact point and the fifth contact point to the first stationary contact point, the second stationary contact point, the third stationary contact point, the fourth stationary contact point and the fifth stationary contact point, respectively.

In one embodiment, when a current passes through the first coil, the first magnetic force causes the balance frame to move towards the first permanent magnet and thereby electrically disconnect the first contact point, the second contact point, the third contact point, the fourth contact point and the fifth contact point from the first stationary contact point, the second stationary contact point, the third stationary contact point, the fourth stationary contact point and the fifth stationary contact point, respectively. When a current passes through the second coil, the second magnetic force causes the balance frame to move towards the second permanent magnet and thereby electrically connect the first contact point, the second contact point, the third contact point, the fourth contact point and the fifth contact point to the first stationary contact point, the second stationary contact point, the third stationary contact point, the fourth stationary contact point and the fifth stationary contact point, respectively.

In one embodiment, the relative motion is a rotation around a first axis that is perpendicular to the axis of one of the second surface of the first arm portion and of the second surface of the second arm portion. In another embodiment, the relative motion is a rotation around a second axis that is perpendicular to the first axis and the axis of one of the second surface of the first arm portion and of the second surface of the second arm portion, respectively.

In one embodiment, the magnetic movement mechanism further comprises a first fixed contact member electrically coupled to the first stationary contact point that is electrically contactable with the first contact point of the first movable contact, and a second fixed contact member electrically coupled to the fourth stationary contact point that is electrically contactable with the fourth contact point of the second movable contact. The first stationary contact point is electrically connectable to the phase wire of a source of electricity, and the fourth stationary contact point is electrically connectable to the neutral wire of the source of electricity, respectively.

In another aspect, the present invention relates to a ground fault circuit interrupter with automatic pressure balance compensation. In one embodiment, the ground fault circuit interrupter comprises: (i) a line phase terminal, a line neutral terminal and a line ground terminal, connectable to a source of electricity, (ii) a load phase terminal, a load neutral terminal and a load ground terminal, connectable to at least one user accessible load, and (iii) a magnetic movement mechanism. The magnetic movement mechanism has: (a) a first permanent magnet, (b) a second permanent magnet positioned apart from the first permanent magnet, (c) a soft magnet with a first end, an opposite, second end, and a body portion defined therebetween, wherein the soft magnet is positioned between the first permanent magnet and the second permanent magnet such that the first end of the soft magnet is proximate to the first permanent magnet, and the second end of the soft magnet is proximate to the second permanent magnet, respectively, (d) a balance frame positioned between the first end and the second end of the soft magnet, wherein the balance frame defines an opening configured to receive the body portion therein so that the balance frame and the soft magnet are movable together, (e) a first coil wound around the first end of the soft magnet, and (f) a second coil wound around the second end of the soft magnet. The first coil and the second coil are arranged such that when a current passes through the first coil, a first magnetic force is generated to cause the soft magnet and the balance frame to move towards the first permanent magnet in a first direction, and when a current passes through the second coil, a second magnetic force is generated to cause the soft magnet and the balance frame to move towards the second permanent magnet in a second direction that is opposite to the first direction.

In one embodiment, the balance frame further comprises a first arm portion extending away radially from the body portion of the soft magnet, and an opposite, second arm portion extending away radially from the body portion of the soft magnet, respectively. Each of the first arm portion and the second arm portion comprises: (i) a body portion having a first surface, an opposite, second surface, at least one first side surface, and an opposite, second side surface, (ii) at least one first position limiting member protruding from the first side surface and away from the second surface, (iii) at least one opposite, second position limiting member protruding from the second side surface and away from the second surface, and (iv) a center position limiting member protruding away from the second surface. The first side surface and the second side surface connect the first surface and the second surface, respectively, and the second surface is configured to have a curvature and a corresponding axis.

In one embodiment, the balance frame further comprises a first movable contact mountable on the second surface of the first arm portion, and a second movable contact mountable on the second surface of the second arm portion of the balance frame, respectively. The first movable contact defines an opening corresponding to the center position limiting member of the first arm portion and is configured such that the when the first movable contact is mounted on the second surface of the first arm portion, the center position limiting member removably engages the first movable contact through the opening. The first movable contact is positioned between the at least one first position limiting member and the at least one opposite, second position limiting member of the first arm portion and at least movable corresponding to the curvature and relative to the axis of the second surface of the first arm portion. The second movable contact defines an opening corresponding to the center position limiting member of the second arm portion and is configured such that the when the second movable contact is mounted on the second surface of the second arm portion, the center position limiting member removably engages the second movable contact through the opening. The second movable contact is positioned between the at least one first position limiting member and the at least one opposite, second position limiting member of the second arm portion and at least movable corresponding to the curvature and relative to the axis of the second surface of the second arm portion, respectively.

In one embodiment, each of the first movable contact and the second movable contact is electrically conductive and has a first end, an opposite, second end, and a body portion defined therebetween. The first movable contact further comprises a first contact point positioned at the first end, and a second contact point and a third contact point positioned at the second end, wherein the second contact point and the third contact point are spaced apart from each other. The second movable contact further comprises a fourth contact point positioned at the first end, and a fifth contact point positioned at the second end.

In one embodiment, the magnetic movement mechanism of the ground fault circuit interrupter further comprises a first stationary contact point, a second stationary contact point, and a third stationary contact point positioned in proximity of and contactable with the first contact point, the second contact point and the third contact point of the first movable contact, respectively. The magnetic movement mechanism further comprises a fourth stationary contact point, and a fifth contact point positioned in proximity of and contactable with the fourth contact point and the fifth contact point of the second movable contact, respectively. The first stationary contact point, the second stationary contact point, the third stationary contact point, the fourth stationary contact point and the fifth stationary contact point are configured such that when a current passes through the first coil, the first magnetic force causes the balance frame to move towards the first permanent magnet and thereby electrically disconnect the first contact point, the second contact point, the third contact point, the fourth contact point and the fifth contact point from the first stationary contact point, the second stationary contact point, the third stationary contact point, the fourth stationary contact point and the fifth stationary contact point, respectively. When a current passes through the second coil, the second magnetic force causes the balance frame to move towards the second permanent magnet and thereby electrically connect the first contact point, the second contact point, the third contact point, the fourth contact point and the fifth contact point to the first stationary contact point, the second stationary contact point, the third stationary contact point, the fourth stationary contact point and the fifth stationary contact point, respectively.

In one embodiment, the magnetic movement mechanism of the ground fault circuit interrupter further comprises a first fixed contact member electrically coupled to the first stationary contact point that is electrically contactable with the first contact point of the first movable contact, and a second fixed contact member electrically coupled to the fourth stationary contact point that is electrically contactable with the fourth contact point of the second movable contact. The line phase terminal is connected to the first stationary contact point and the line neutral terminal is connected to the fourth stationary contact point. The load phase terminal is connected to the second stationary contact point and the load neutral terminal is connected to the fifth stationary contact point, respectively.

In one embodiment, when a current passes through the first coil, the first magnetic force causes the balance frame to move towards the first permanent magnet and thereby electrically disconnect the first contact point, the second contact point, the third contact point, the fourth contact point and the fifth contact point from the first stationary contact point, the second stationary contact point, the third stationary contact point, the fourth stationary contact point and the fifth stationary contact point, respectively, such that the source of electricity is disconnected from the at least one user accessible load, and when a current passes through the second coil, the second magnetic force causes the balance frame to move towards the second permanent magnet and thereby electrically connect the first contact point, the second contact point, the third contact point, the fourth contact point and the fifth contact point to the first stationary contact point, the second stationary contact point, the third stationary contact point, the fourth stationary contact point and the fifth stationary contact point, respectively, such that the source of electricity is connected from the at least one user accessible load.

In one embodiment, the magnetic movement mechanism further comprises a first fixed contact member electrically coupled to the first stationary contact point that is electrically contactable with the first contact point of the first movable contact, and a second fixed contact member electrically coupled to the fourth stationary contact point that is electrically contactable with the fourth contact point of the second movable contact. The first stationary contact point is electrically connectable to the phase wire of a source of electricity, and the fourth stationary contact point is electrically connectable to the neutral wire of the source of electricity, respectively.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

Further features and benefits of the present invention will be apparent from a detailed description of preferred embodiments thereof taken in conjunction with the following drawings, wherein similar elements are referred to with similar reference numbers, and wherein:

FIG. 2A is a side view of the magnetic movement mechanism having automatic pressure balance compensation, and FIG. 2B is front view of the magnetic movement mechanism having automatic pressure balance compensation;

DETAILED DESCRIPTION OF THE PRESENT INVENTION

Figure 1:
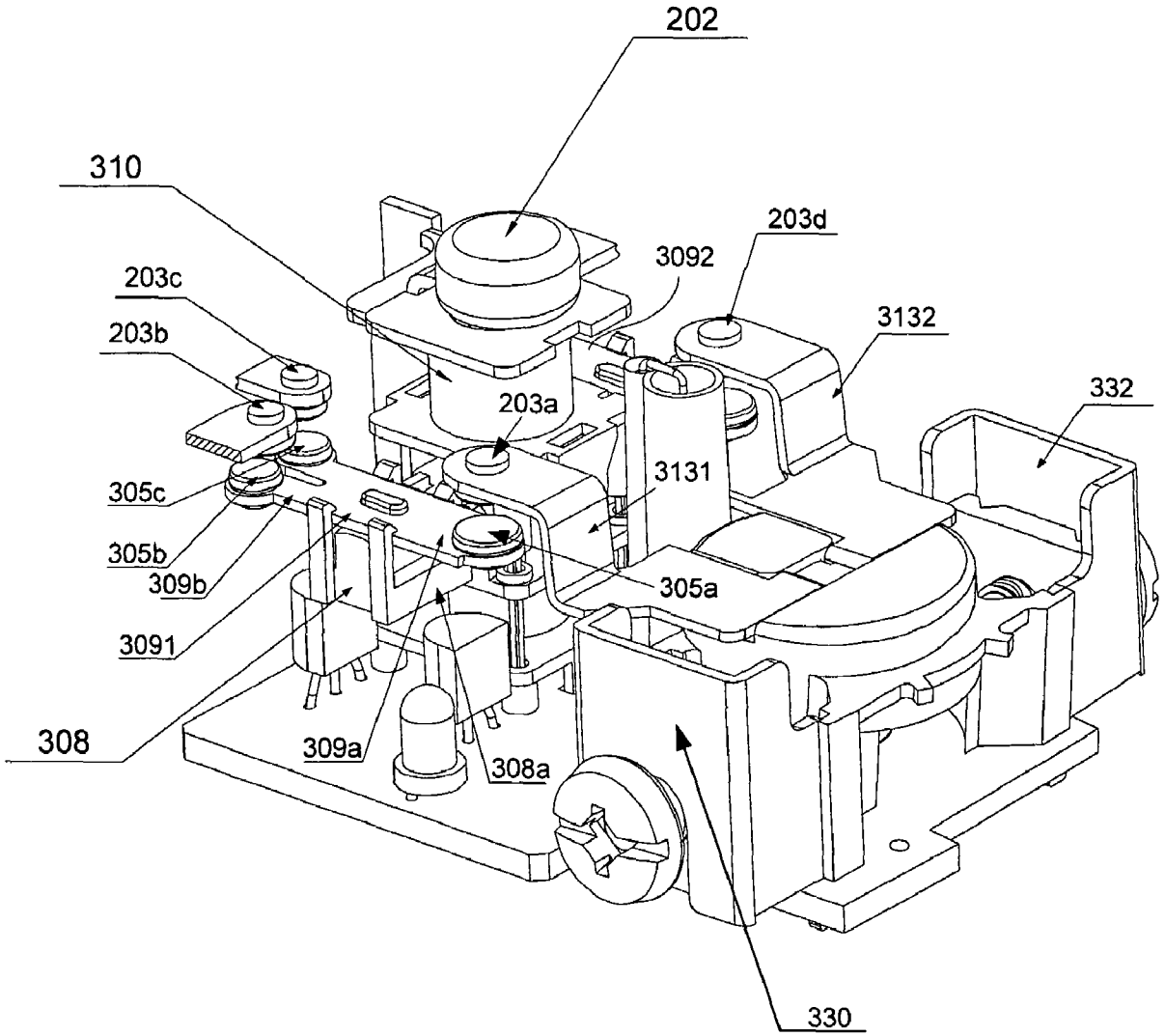
FIG. 1 shows a perspective view of a partially assembled ground fault circuit interrupter with a magnetic movement mechanism having automatic pressure balance compensation, when contact points and the stationary contact points are not contacted, according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

Prior to a detailed description of the present invention(s), the following definitions are provided as an aid to understanding the subject matter and terminology of aspects of the present invention(s), and not necessarily limiting of the present invention(s), which are expressed in the claims. Whether or not a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. A capitalized term within the glossary usually indicates that the capitalized term has a separate definition within the glossary. However, the capitalization or lack thereof within the remainder of this document is not intended to be necessarily limiting unless the context clearly indicates that such limitation is intended.

DEFINITIONS/GLOSSARY

AFCI: arc fault circuit interrupter.
GFCI: ground fault circuit interrupter.

SYSTEM OVERVIEW

The description will be made as to the embodiments of the present invention in conjunction with the reference to the accompanying drawings in FIGS. 1-4. In accordance with the purposes of this invention, as embodied and broadly described herein, this invention, in one aspect, relates to a permanent magnetic movement mechanism for a ground fault circuit interrupter.

FIG. 1 shows a perspective view of a partially assembled ground fault circuit interrupter with a magnetic movement mechanism having automatic pressure balance compensation, according to one embodiment of the present invention. The magnetic movement mechanism comprises: (i) a first permanent magnet 201, (ii) a second permanent magnet 202 positioned apart from the first permanent magnet 201, (iii) a soft magnet 312 with a first end 312*a*, an opposite, second end 312*b*, and a body portion 312*c* defined therebetween, (iv) a balance frame 308 positioned between the first end 312*a* and the second end 312*b* of the soft magnet 312, which defines an opening configured to receive the body portion 312*c* therein so that the balance frame 308 and the soft magnet 312 are movable together, (v) a first coil 311 wound around the first end 312*a* of the soft magnet 312, and (vi) a second coil 310 wound around the second end 312*b* of the soft magnet 312.

The soft magnet 312 is positioned between the first permanent magnet 201 and the second permanent magnet 202 such that the first end 312*a* of the soft magnet 312 is proximate to the first permanent magnet 201, and the second end 312*b* of the soft magnet 312 is proximate to the second permanent magnet 202, respectively. The first coil 311 and the second coil 310 are arranged such that when a current passes through the first coil 311, a first magnetic force is generated to cause the soft magnet 312 and the balance frame 308 to move towards the first permanent magnet 201 in a first direction, and when a current passes through the second coil 310, a second magnetic force is generated to cause the soft magnet 312 and the balance frame 308 to move towards the second permanent magnet 202 in a second direction that is opposite to the first direction.

The balance frame 308 further comprises a first arm portion 308*a* extending away radially from the body portion 312*c* (not shown in FIG. 1) of the soft magnet 312 (not shown in FIG. 1), and an opposite, second arm portion 308*b* (not shown in FIG. 1) extending away radially from the body portion 312*c* (not shown in FIG. 1) of the soft magnet 312 (not shown in FIG. 1), respectively.

Figure 2:
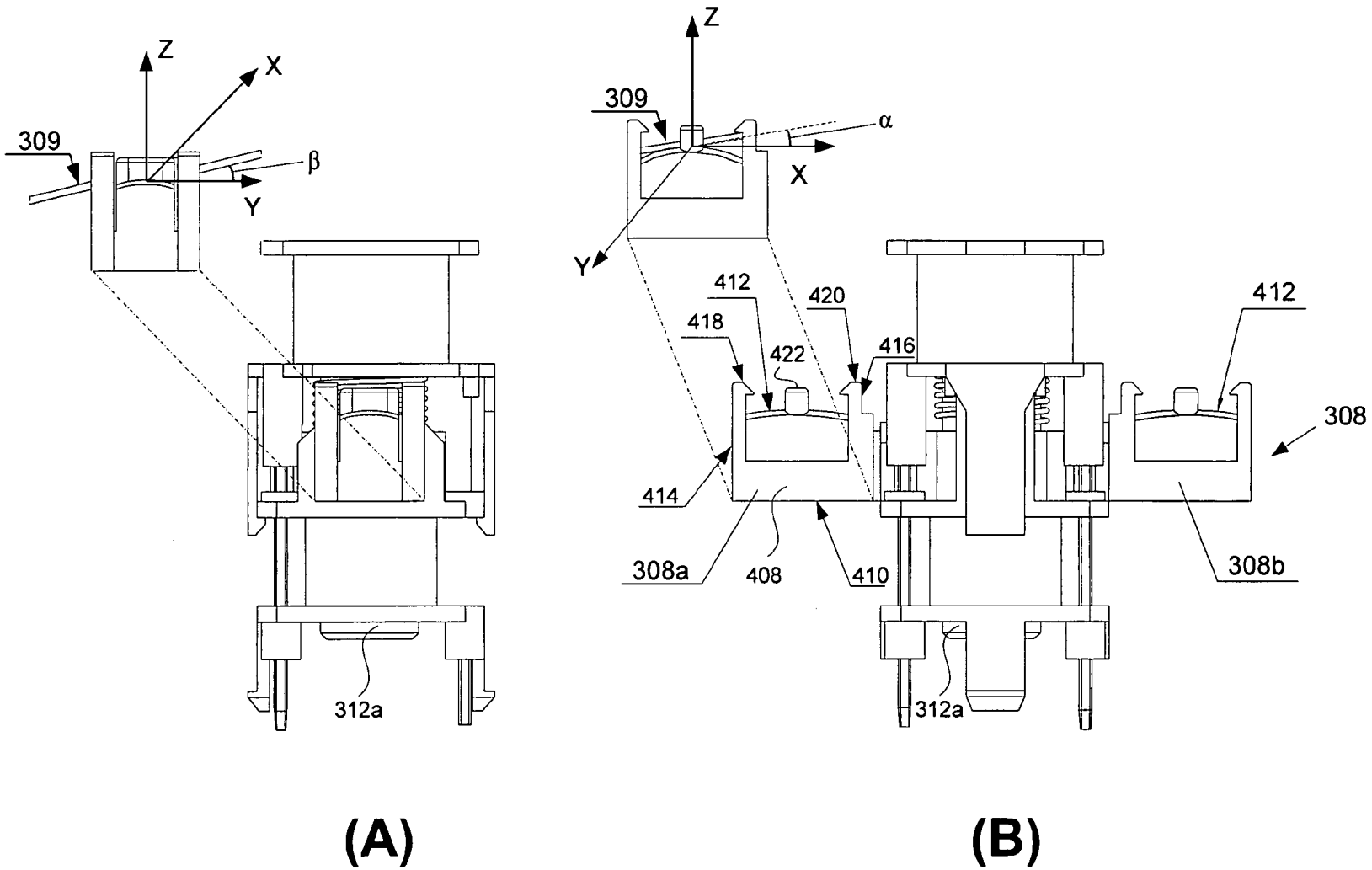
FIG. 2 shows a magnetic movement mechanism having automatic pressure balance compensation from different angles, according to one embodiment of the present invention.

Referring now to FIG. 1 and FIG. 2, each of the first arm portion 308*a* (shown in both FIG. 1 and FIG. 2) and the second arm portion 308*b* (not shown in FIG. 1, shown in FIG. 2) comprises: (i) a body portion 408, (ii) at least one first position limiting member 418, (iii) at least one opposite, second position limiting member 420, and (iv) a center position limiting member 422. As shown in FIG. 2B, the body portion 408 has a first surface 410, an opposite, second surface 412, at least one first side surface 414, and an opposite, second side surface 416. The first side surface 414 and the second side surface 416 connect the first surface 410 and the second surface 412, respectively. The second surface 412 is configured to have a curvature and a corresponding axis. The first position limiting member 418 protrudes from the first side surface 414 and away from the second surface 412. The second position limiting member 420 protrudes from the second side surface 416 and away from the second surface 412. The center position limiting member 422 protrudes away from the second surface 412.

Referring now back to FIG. 1, the balance frame further comprises a first movable contact 3091 mountable on the second surface 412 of the first arm portion 308*a*, and a second movable contact 3092 mountable on the second surface 412 of the second arm portion 308*b* of the balance frame, respectively. The first movable contact 3091 defines an opening corresponding to the center position limiting member 422 of the first arm portion 308*a* and is configured such that the when the first movable contact 3091 is mounted on the second surface 412 of the first arm portion 308*a*, the center position limiting member 422 removably engages the first movable contact 3091 through the opening and the first movable contact 3091 is positioned between the at least one first position limiting member and the at least one opposite, second position limiting member of the first arm portion 308*a* and at least movable corresponding to the curvature and relative to the axis of the second surface of the first arm portion 308*a*. The second movable contact 3092 defines an opening corresponding to the center position limiting member of the second arm portion 308*b* (not shown in FIG. 1) and is configured such that the when the second movable contact 3092 is mounted on the second surface of the second arm portion 308*b*, the center position limiting member removably engages the second movable contact 3092 through the opening and the second movable contact 3092 is positioned between the at least one first position limiting member and the at least one opposite, second position limiting member of the second arm portion 308*b* and at least movable corresponding to the curvature and relative to the axis of the second surface of the second arm portion 308*b*, respectively.

Each of the first movable contact 3091 and the second movable contact 3092 is electrically conductive and has a first end 309*a*, an opposite, second end 309*b* and a body portion 309 defined therebetween. The first movable contact 3091 further comprises a first contact point 305*a* positioned at the first end 309*a*, and a second contact point 305*b* and a third contact point 305*c* positioned at the second end 309*b*, wherein the second contact point 305*b* and the third contact point 305*c* are spaced apart from each other. The second movable contact 3092 further comprises a fourth contact point 305*d* positioned at the first end 309*a*, and a fifth contact point 305*e* positioned at the second end 309*b*.

In one embodiment, the magnetic movement mechanism further comprises: (i) a first stationary contact point 203*a*, (ii) a second stationary contact point 203*b*, and (iii) a third stationary contact point 203*c*, (iv) a fourth stationary contact point 203*d*, and (v) a fifth contact point 203*e* (not shown in FIG. 1). The first, the second and the third stationary contact points are positioned in proximity of and contactable with the first contact point 305*a*, the second contact point 305*b* and the third contact point 305*c* of the first movable contact 3091, respectively. The fourth and the fifth stationary contact points are positioned in proximity of and contactable with the fourth contact point 305*d* and the fifth contact point 305*e* (not shown in FIG. 1) of the second movable contact 3092, respectively. The first stationary contact point 203*a*, the second stationary contact point 203*b*, the third stationary contact point 203*c*, the fourth stationary contact point 203*d* and the fifth stationary contact point 203*e* are configured such that when a current passes through the first coil 310, the first magnetic force causes the balance frame to move towards the first permanent magnet 201 and thereby electrically disconnect the first contact point 305*a*, the second contact point 305*b*, the third contact point 305*c*, the fourth contact point 305*d* and the fifth contact point 305*e* from the first stationary contact point 203*a*, the second stationary contact point 203*b*, the third stationary contact point 203*c*, the fourth stationary contact point 203*d* and the fifth stationary contact point 203*e*, respectively. When a current passes through the second coil 311, the second magnetic force causes the balance frame 308 to move towards the second permanent magnet 202 and thereby electrically connect the first contact point 305*a*, the second contact point 305*b*, the third contact point 305*c*, the fourth contact point 305*d* and the fifth contact point 305*e* to the first stationary contact point 203*a*, the second stationary contact point 203*b*, the third stationary contact point 203*c*, the fourth stationary contact point 203*d* and the fifth stationary contact point 203*e*, respectively.

Referring now to FIG. 2, the second surface 412 is configured to have a curvature. A vertical axis Z exists along the direction of center position limiting member 422 away from the second surface 412. On a plane that is perpendicular to the axis Z, there exist two axes X and Y, perpendicular to each other. Once the first movable contact 3091 is mounted on the second surface 412, the first movable contact 3091 is engaged with the first position limiting member 418, the second position limiting member 420, and the center position limiting member 422. Its movement is limited by the first position limiting member 418, the second position limiting member 420, and the center position limiting member 422. As shown in FIG. 2A, the movable contact 309 can be tilted to an angle shown as β from the Y axis. As shown in FIG. 2B, the movable contact 309 can be tilted to an angle shown as α from the X axis. Such position of the movable contact 309 may occur only when the first end 312*a* of the soft magnet 312 moves to or attaches to the first permanent magnet 201. When the second end 312*b* of the soft magnet 312 moves to or attaches to the second permanent magnet 202, the contact points on the movable contact 309 are fully contacted to the stationary contact points. Due to the curvature on the second surface 412, the pressure on the first end 309*a* and the second end 309*b* are balanced such that the contacts between the contact points 305*a*-305*e* and the stationary contact points 203*a*-203*e* are optimally reliable.

When a current passes through the first coil 310, the first magnetic force causes the balance frame to move towards the first permanent magnet 201 and thereby electrically disconnect the first contact point 305*a*, the second contact point 305*b*, the third contact point 305*c*, the fourth contact point 305*d* and the fifth contact point 305*e* from the first stationary contact point 203*a*, the second stationary contact point 203*b*, the third stationary contact point 203*c*, the fourth stationary contact point 203*d* and the fifth stationary contact point 203*e*, respectively. When a current passes through the second coil 311, the second magnetic force causes the balance frame 308 to move towards the second permanent magnet 202 and thereby electrically connect the first contact point 305*a*, the second contact point 305*b*, the third contact point 305*c*, the fourth contact point 305*d* and the fifth contact point 305*e* to the first stationary contact point 203*a*, the second stationary contact point 203*b*, the third stationary contact point 203*c*, the fourth stationary contact point 203*d* and the fifth stationary contact point 203*e*, respectively.

Still referring to FIG. 1, the magnetic movement mechanism further comprises a first fixed contact member 3131 electrically coupled to the first stationary contact point 203*a* that is electrically contactable with the first contact point 305*a* of the first movable contact 3091, and a second fixed contact member 3132 electrically coupled to the fourth stationary contact point 203*d* that is electrically contactable with the fourth contact point 305*d* of the second movable contact 3092, wherein the first stationary contact point 203*a* is electrically connectable to the phase wire of a source of electricity, and the fourth stationary contact point 203*d* is electrically connectable to the neutral wire of the source of electricity, respectively.

In one embodiment, a ground fault circuit interrupter with automatic pressure balance compensation, comprises: (i) a line phase terminal 330, a line neutral terminal 332 and a line ground terminal (not shown in FIG. 1), (ii) a load phase terminal (not shown in FIG. 1), a load neutral terminal (not shown in FIG. 1) and a load ground terminal (not shown in FIG. 1), and (iii) a magnetic movement mechanism with automatic pressure balance compensation as described above. The line phase terminal, the line neutral terminal and the line ground terminal are connectable to a source of electricity. The load phase terminal, the load neutral terminal and the load ground terminal are connectable to at least one user accessible load. In this embodiment, the line phase terminal 330 is connected to the first fixed contact member 3131 and the line neutral terminal 332 is connected to the second fixed contact member 3132.

Figure 4:
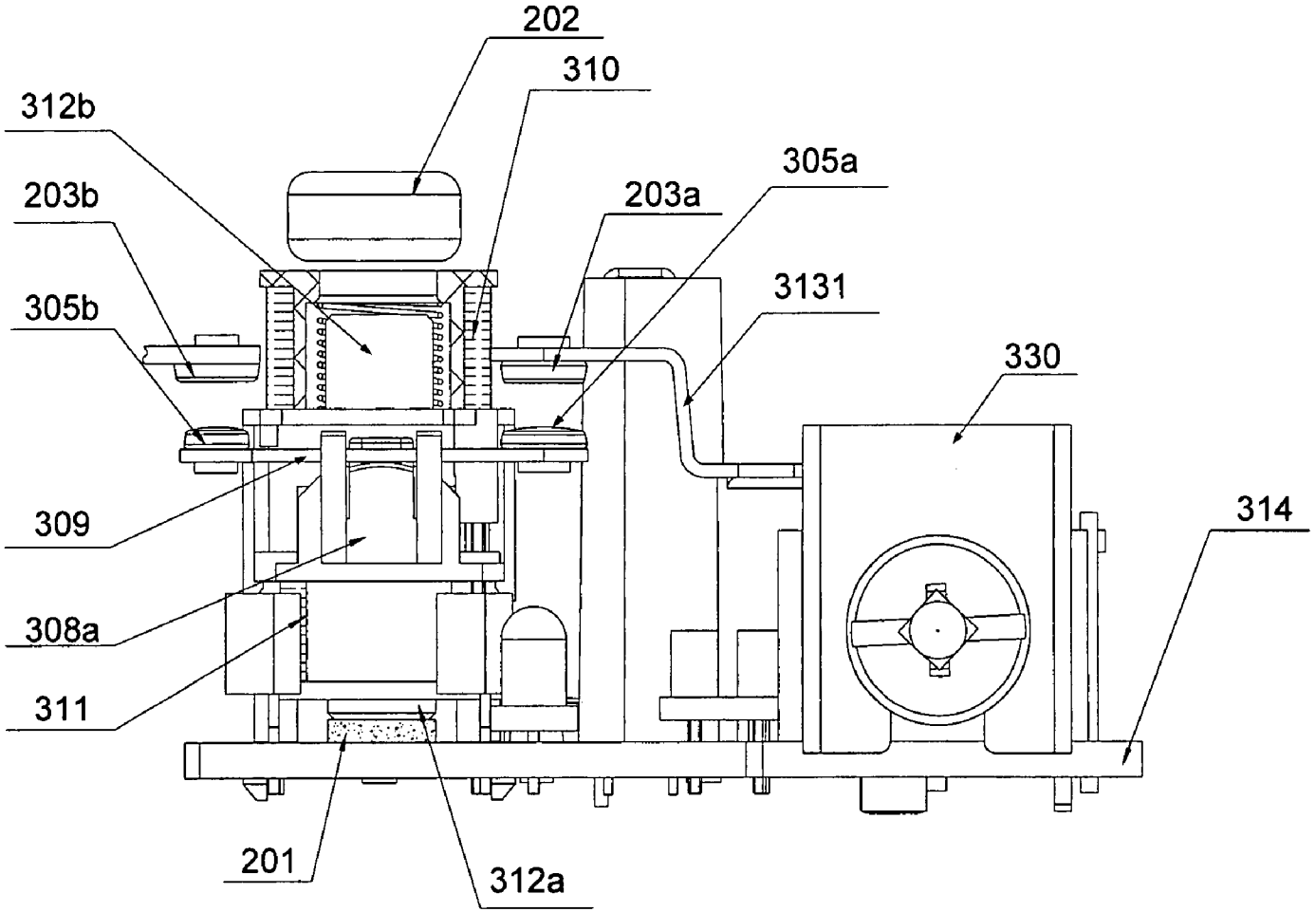
FIG. 4 shows a side view of a partially assembled ground fault circuit interrupter with a magnetic movement mechanism having automatic pressure balance compensation, when contact points and the stationary contact points are not contacted, according to one embodiment of the present invention.

When a current passes through the first coil 310, the first magnetic force causes the balance frame to move towards the first permanent magnet 201 and thereby electrically disconnect the first contact point 305*a*, the second contact point 305*b*, the third contact point 305*c*, the fourth contact point 305*d* and the fifth contact point 305*e* from the first stationary contact point 203*a*, the second stationary contact point 203*b*, the third stationary contact point 203*c*, the fourth stationary contact point 203*d* and the fifth stationary contact point 203*e*, respectively, such that the source of electricity is disconnected from the at least one user accessible load as shown in FIG. 4. FIG. 4 shows a side view of a partially assembled ground fault circuit interrupter with a magnetic movement mechanism having automatic pressure balance compensation, when contact points and the stationary contact points are not contacted, according to one embodiment of the present invention.

Figure 3:
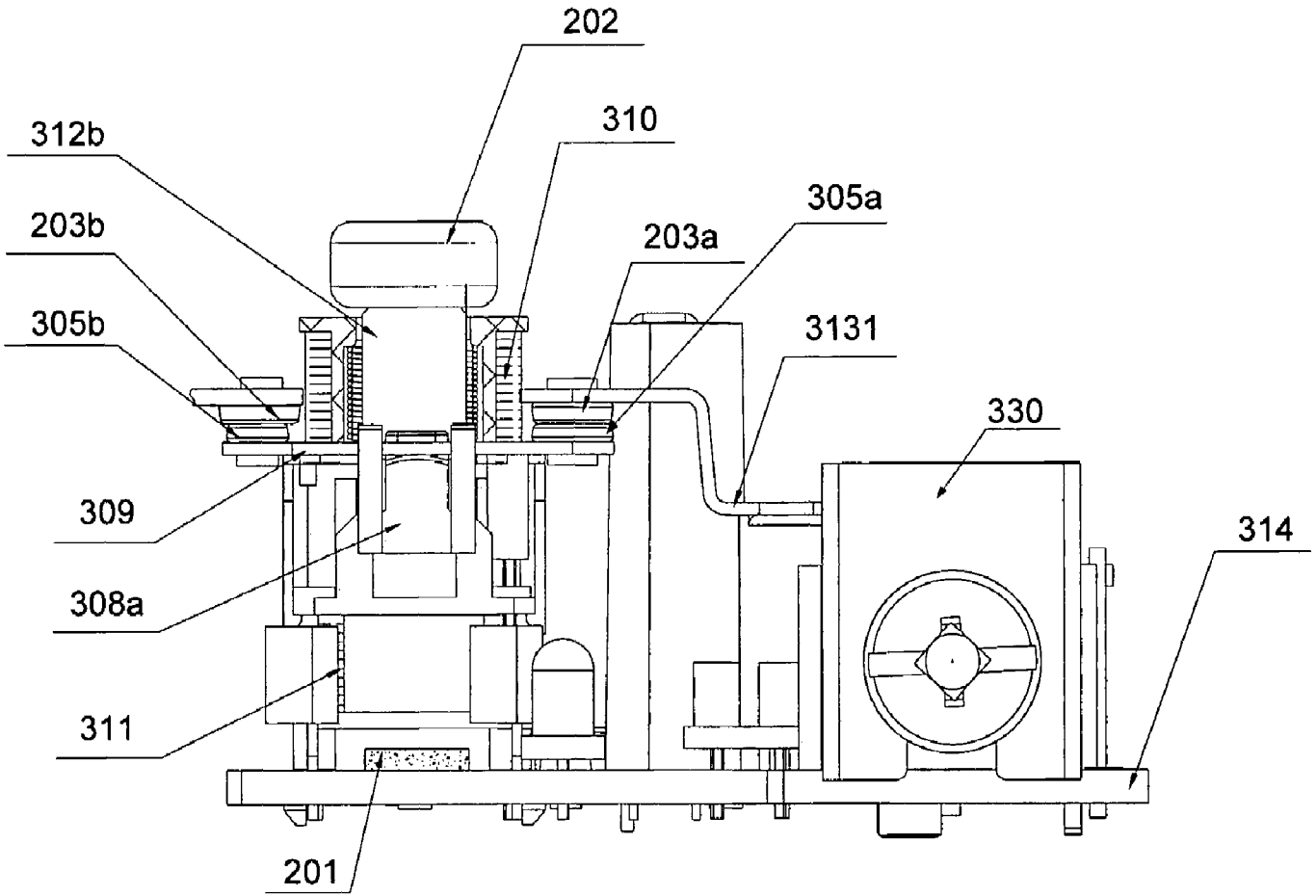
FIG. 3 shows a side view of a partially assembled ground fault circuit interrupter with a magnetic movement mechanism having automatic pressure balance compensation, when contact points and stationary contact points are fully contacted, according to one embodiment of the present invention.

When a current passes through the second coil 311, the second magnetic force causes the balance frame 308 to move towards the second permanent magnet 202 and thereby electrically connect the first contact point 305*a*, the second contact point 305*b*, the third contact point 305*c*, the fourth contact point 305*d* and the fifth contact point 305*e* to the first stationary contact point 203*a*, the second stationary contact point 203*b*, the third stationary contact point 203*c*, the fourth stationary contact point 203*d* and the fifth stationary contact point 203*e*, respectively, such that the source of electricity is connected to the at least one user accessible load as shown in FIG. 3. FIG. 3 shows a side view of a partially assembled ground fault circuit interrupter with a magnetic movement mechanism having automatic pressure balance compensation, when contact points and stationary contact points are fully contacted, according to one embodiment of the present invention.

The above features as well as additional features and aspects of the present invention are disclosed herein and will become apparent from the foregoing description of preferred embodiments of the present invention.

While there has been shown several and alternate embodiments of the present invention, it is to be understood that certain changes can be made as would be known to one skilled in the art without departing from the underlying scope of the present invention as is discussed and set forth above and below including claims. Furthermore, the embodiments described above and claims set forth below are only intended to illustrate the principles of the present invention and are not intended to limit the scope of the present invention to the disclosed elements.

What is claimed is:

1. A magnetic movement mechanism usable in a ground fault circuit interrupter, comprising:

(i) a first permanent magnet;

(ii) a second permanent magnet positioned apart from the first permanent magnet;

(iii) a soft magnet with a first end, an opposite, second end, and a body portion defined therebetween, wherein the soft magnet is positioned between the first permanent magnet and the second permanent magnet such that the first end of the soft magnet is proximate to the first permanent magnet, and the second end of the soft magnet is proximate to the second permanent magnet, respectively;

(iv) a balance frame positioned between the first end and the second end of the soft magnet, wherein the balance frame defines an opening configured to receive the body portion therein so that the balance frame and the soft magnet are movable together;

(v) a first coil wound around the first end of the soft magnet; and (vi) a second coil wound around the second end of the soft magnet, wherein the first coil and the second coil are arranged such that when a current passes through the first coil, a first magnetic force is generated to cause the soft magnet and the balance frame to move towards the first permanent magnet in a first direction, and when a current passes through the second coil, a second magnetic force is generated to cause the soft magnet and the balance frame to move towards the second permanent magnet in a second direction that is opposite to the first direction;

wherein the balance frame further comprises a first arm portion extending away radially from the body portion of the soft magnet, and an opposite, second arm portion extending away radially from the body portion of the soft magnet, respectively; and wherein each of the first arm portion and the second arm portion comprises:

(a) a body portion having a first surface, an opposite, second surface, at least one first side surface, and an opposite, second side surface, wherein the first side surface and the second side surface connect the first surface and the second surface, respectively, and wherein the second surface is configured to have a curvature and a corresponding axis;

(b) at least one first position limiting member protruding from the first side surface and away from the second surface;

(c) at least one opposite, second position limiting member protruding from the second side surface and away from the second surface; and (d) a center position limiting member protruding away from the second surface.

2. The magnetic movement mechanism of claim 1, wherein the balance frame further comprises a first movable contact mountable on the second surface of the first arm portion, and a second movable contact mountable on the second surface of the second arm portion of the balance frame, respectively, and wherein the first movable contact defines an opening corresponding to the center position limiting member of the first arm portion and is configured such that the when the first movable contact is mounted on the second surface of the first arm portion, the center position limiting member removably engages the first movable contact through the opening and the first movable contact is positioned between the at least one first position limiting member and the at least one opposite, second position limiting member of the first arm portion and at least movable corresponding to the curvature and relative to the axis of the second surface of the first arm portion, and the second movable contact defines an opening corresponding to the center position limiting member of the second arm portion and is configured such that the when the second movable contact is mounted on the second surface of the second arm portion, the center position limiting member removably engages the second movable contact through the opening and the second movable contact is positioned between the at least one first position limiting member and the at least one opposite, second position limiting member of the second arm portion and at least movable corresponding to the curvature and relative to the axis of the second surface of the second arm portion, respectively.

3. The magnetic movement mechanism of claim 2, wherein each of the first movable contact and the second movable contact is electrically conductive and has a first end, an opposite, second end, and a body portion defined therebetween.

4. The magnetic movement mechanism of claim 3, wherein the first movable contact further comprises a first contact point positioned at the first end, and a second contact point and a third contact point positioned at the second end, wherein the second contact point and the third contact point are spaced apart from each other.

5. The magnetic movement mechanism of claim 4, wherein the second movable contact further comprises a fourth contact point positioned at the first end, and a fifth contact point positioned at the second end.

6. The magnetic movement mechanism of claim 5, further comprises a first stationary contact point, a second stationary contact point, and a third stationary contact point positioned in proximity of and contactable with the first contact point, the second contact point and the third contact point of the first movable contact, respectively, and a fourth stationary contact point, and a fifth contact point positioned in proximity of and contactable with the fourth contact point and the fifth contact point of the second movable contact, respectively, wherein the first stationary contact point, the second stationary contact point, the third stationary contact point, the fourth stationary contact point and the fifth stationary contact point are configured such that when a current passes through the first coil, the first magnetic force causes the balance frame to move towards the first permanent magnet and thereby electrically disconnect the first contact point, the second contact point, the third contact point, the fourth contact point and the fifth contact point from the first stationary contact point, the second stationary contact point, the third stationary contact point, the fourth stationary contact point and the fifth stationary contact point, respectively, and when a current passes through the second coil, the second magnetic force causes the balance frame to move towards the second permanent magnet and thereby electrically connect the first contact point, the second contact point, the third contact point, the fourth contact point and the fifth contact point to the first stationary contact point, the second stationary contact point, the third stationary contact point, the fourth stationary contact point and the fifth stationary contact point, respectively.

7. The magnetic movement mechanism of claim 6, wherein when a current passes through the first coil, the first magnetic force causes the balance frame to move towards the first permanent magnet and thereby electrically disconnect the first contact point, the second contact point, the third contact point, the fourth contact point and the fifth contact point from the first stationary contact point, the second stationary contact point, the third stationary contact point, the fourth stationary contact point and the fifth stationary contact point, respectively, and when a current passes through the second coil, the second magnetic force causes the balance frame to move towards the second permanent magnet and thereby electrically connect the first contact point, the second contact point, the third contact point, the fourth contact point and the fifth contact point to the first stationary contact point, the second stationary contact point, the third stationary contact point, the fourth stationary contact point and the fifth stationary contact point, respectively.

8. The magnetic movement mechanism of claim 7, wherein the relative motion is a rotation around a first axis that is perpendicular to the axis of one of the second surface of the first arm portion and of the second surface of the second arm portion.

9. The magnetic movement mechanism of claim 8, wherein the relative motion is a rotation around a second axis that is perpendicular to the first axis and the axis of one of the second surface of the first arm portion and of the second surface of the second arm portion, respectively.

10. The magnetic movement mechanism of claim 6, further comprises a first fixed contact member electrically coupled to the first stationary contact point that is electrically contactable with the first contact point of the first movable contact, and a second fixed contact member electrically coupled to the fourth stationary contact point that is electrically contactable with the fourth contact point of the second movable contact, wherein the first stationary contact point is electrically connectable to the phase wire of a source of electricity, and the fourth stationary contact point is electrically connectable to the neutral wire of the source of electricity, respectively.

11. A ground fault circuit interrupter with automatic pressure balance compensation, comprising:

(i) a line phase terminal, a line neutral terminal and a line ground terminal, wherein the line phase terminal, the line neutral terminal and the line ground terminal are connectable to a source of electricity;

(ii) a load phase terminal, a load neutral terminal and a load ground terminal, wherein the load phase terminal, the load neutral terminal and the load ground terminal are connectable to at least one user accessible load; and (iii) a magnetic movement mechanism, wherein the magnetic movement mechanism has:

(A) a first permanent magnet;

(B) a second permanent magnet positioned apart from the first permanent magnet;

(C) a soft magnet with a first end, an opposite, second end, and a body portion defined therebetween, wherein the soft magnet is positioned between the first permanent magnet and the second permanent magnet such that the first end of the soft magnet is proximate to the first permanent magnet, and the second end of the soft magnet is proximate to the second permanent magnet, respectively;

(D) a balance frame positioned between the first end and the second end of the soft magnet, wherein the balance frame defines an opening configured to receive the body portion therein so that the balance frame and the soft magnet are movable together;

(E) a first coil wound around the first end of the soft magnet; and (F) a second coil wound around the second end of the soft magnet, wherein the first coil and the second coil are arranged such that when a current passes through the first coil, a first magnetic force is generated to cause the soft magnet and the balance frame to move towards the first permanent magnet in a first direction, and when a current passes through the second coil, a second magnetic force is generated to cause the soft magnet and the balance frame to move towards the second permanent magnet in a second direction that is opposite to the first direction, wherein the balance frame further comprises a first arm portion extending away radially from the body portion of the soft magnet, and an opposite, second arm portion extending away radially from the body portion of the soft magnet, respectively; and wherein each of the first arm portion and the second arm portion comprises:

(a) a body portion having a first surface, an opposite, second surface, at least one first side surface, and an opposite, second side surface, wherein the first side surface and the second side surface connect the first surface and the second surface, respectively, and wherein the second surface is configured to have a curvature and a corresponding axis;

(b) at least one first position limiting member protruding from the first side surface and away from the second surface;

(c) at least one opposite, second position limiting member protruding from the second side surface and away from the second surface; and (d) a center position limiting member protruding away from the second surface.

12. The ground fault circuit interrupter of claim 11, wherein the balance frame further comprises a first movable contact mountable on the second surface of the first arm portion, and a second movable contact mountable on the second surface of the second arm portion of the balance frame, respectively, and wherein the first movable contact defines an opening corresponding to the center position limiting member of the first arm portion and is configured such that the when the first movable contact is mounted on the second surface of the first arm portion, the center position limiting member removably engages the first movable contact through the opening and the first movable contact is positioned between the at least one first position limiting member and the at least one opposite, second position limiting member of the first arm portion and at least movable corresponding to the curvature and relative to the axis of the second surface of the first arm portion, and the second movable contact defines an opening corresponding to the center position limiting member of the second arm portion and is configured such that the when the second movable contact is mounted on the second surface of the second arm portion, the center position limiting member removably engages the second movable contact through the opening and the second movable contact is positioned between the at least one first position limiting member and the at least one opposite, second position limiting member of the second arm portion and at least movable corresponding to the curvature and relative to the axis of the second surface of the second arm portion, respectively.

13. The ground fault circuit interrupter of claim 12, wherein each of the first movable contact and the second movable contact is electrically conductive and has a first end, an opposite, second end, and a body portion defined therebetween.

14. The ground fault circuit interrupter of claim 13, wherein the first movable contact further comprises a first contact point positioned at the first end, and a second contact point and a third contact point positioned at the second end, wherein the second contact point and the third contact point are spaced apart from each other.

15. The ground fault circuit interrupter of claim 14, wherein the second movable contact further comprises a fourth contact point positioned at the first end, and a fifth contact point positioned at the second end.

16. The ground fault circuit interrupter of claim 15, further comprises a first stationary contact point, a second stationary contact point, and a third stationary contact point positioned in proximity of and contactable with the first contact point, the second contact point and the third contact point of the first movable contact, respectively, and a fourth stationary contact point, and a fifth contact point positioned in proximity of and contactable with the fourth contact point and the fifth contact point of the second movable contact, respectively, wherein the first stationary contact point, the second stationary contact point, the third stationary contact point, the fourth stationary contact point and the fifth stationary contact point are configured such that when a current passes through the first coil, the first magnetic force causes the balance frame to move towards the first permanent magnet and thereby electrically disconnect the first contact point, the second contact point, the third contact point, the fourth contact point and the fifth contact point from the first stationary contact point, the second stationary contact point, the third stationary contact point, the fourth stationary contact point and the fifth stationary contact point, respectively, and when a current passes through the second coil, the second magnetic force causes the balance frame to move towards the second permanent magnet and thereby electrically connect the first contact point, the second contact point, the third contact point, the fourth contact point and the fifth contact point to the first stationary contact point, the second stationary contact point, the third stationary contact point, the fourth stationary contact point and the fifth stationary contact point, respectively.

17. The ground fault circuit interrupter of claim 16, further comprises a first fixed contact member electrically coupled to the first stationary contact point that is electrically contactable with the first contact point of the first movable contact, and a second fixed contact member electrically coupled to the fourth stationary contact point that is electrically contactable with the fourth contact point of the second movable contact, wherein the line phase terminal is connected to the first stationary contact point, the line neutral terminal is connected to the fourth stationary contact point, the load phase terminal is connected to the second stationary contact point, and the load neutral terminal is connected to the fifth stationary contact point, respectively.

18. The ground fault circuit interrupter of claim 17, wherein when a current passes through the first coil, the first magnetic force causes the balance frame to move towards the first permanent magnet and thereby electrically disconnect the first contact point, the second contact point, the third contact point, the fourth contact point and the fifth contact point from the first stationary contact point, the second stationary contact point, the third stationary contact point, the fourth stationary contact point and the fifth stationary contact point, respectively, such that the source of electricity is disconnected from the at least one user accessible load, and when a current passes through the second coil, the second magnetic force causes the balance frame to move towards the second permanent magnet and thereby electrically connect the first contact point, the second contact point, the third contact point, the fourth contact point and the fifth contact point to the first stationary contact point, the second stationary contact point, the third stationary contact point, the fourth stationary contact point and the fifth stationary contact point, respectively, such that the source of electricity is connected from the at least one user accessible load.

19. The ground fault circuit interrupter of claim 18, wherein the relative motion is a rotation around a first axis that is perpendicular to the axis of one of the second surface of the first arm portion and of the second surface of the second arm portion.

20. The ground fault circuit interrupter of claim 19, wherein the relative motion is a rotation around a second axis that is perpendicular to the first axis and the axis of one of the second surface of the first arm portion and of the second surface of the second arm portion, respectively.

* * * * *